US005416957A

United States Patent [19]

Renzi, Sr. et al.

[11] Patent Number: 5,416,957

[45] Date of Patent: May 23, 1995

[54] IMPACT CUSHION FOR SEAT BELT LATCH

[76] Inventors: Richard A. Renzi, Sr., 6102 Juneberry Ct., Alexandria, Va. 22310; Richard A. Renzi, Jr., 116 S. Coates St., Apt. #7, Daytona Beach, Fla. 32118

[21] Appl. No.: 98,889

[22] Filed: Jul. 29, 1993

[51] Int. Cl.[6] ..... A44B 11/26

[52] U.S. Cl. ..... 24/633; 24/573.1

[58] Field of Search ..... 24/633, 573.1, 634, 24/637

[56] References Cited

U.S. PATENT DOCUMENTS

| | | | |
|---|---|---|---|
| D. 304,779 | 11/1989 | Raphael et al. | 2/639 |
| 4,497,094 | 2/1985 | Morris | 24/633 |
| 4,535,514 | 8/1985 | Grabowski | 24/633 |
| 4,624,033 | 11/1986 | Orton | 24/633 |
| 4,674,303 | 6/1987 | Salcone | 24/633 |
| 4,693,495 | 9/1987 | LaPointe | 280/808 |
| 4,699,401 | 10/1987 | Saenz | 280/808 |
| 4,731,912 | 3/1988 | Boriskie et al. | 24/633 |
| 4,786,080 | 12/1988 | Jay | 280/808 |
| 4,795,190 | 1/1989 | Weightman et al. | 280/808 |
| 4,838,378 | 6/1989 | Copes | 280/808 |
| 4,939,824 | 7/1990 | Reed | 24/633 |
| 4,944,530 | 7/1990 | Spurrier | 280/801 |
| 5,129,129 | 7/1992 | Collins et al. | 24/633 |
| 5,165,149 | 11/1992 | Nihei | 24/633 |
| 5,307,544 | 5/1994 | Quarberg et al. | 24/633 |

*Primary Examiner*—Laurie K. Cranmer

*Attorney, Agent, or Firm*—Kimmel, Crowell & Weaver

[57] ABSTRACT

An impact cushion for a seat belt latch includes a sleeve of a latex rubber material sized to slide lengthwise over a female seat belt connector, with an interference fit. The front side of the sleeve has an opening in a position corresponding to the release button of the connector, so that the button is not obstructed. The rear of the cushion is provided with a rigid metal plate; segmented ribs running lengthwise along the inside upper and lower surfaces of the sleeve hold the rear of the seat belt a short distance away from the plate. The cushion is intended to reduce the incidence of seat belt buckle failure during accidents, resulting from impact directly to the buckle.

8 Claims, 2 Drawing Sheets

IMPACT CUSHION FOR SEAT BELT LATCH

BACKGROUND OF THE INVENTION

This invention relates generally to safety restraints, and more particularly to an impact cushion for a seat belt latch.

Over the years, there have been some reported instances of seat belts having failed during automobile crashes because of impacts to the belt connectors. It has been found, surprisingly, that sometimes release-causing impacts are delivered to the belt by a passenger's body, particularly by the hip bone, that is, from the rear of the latch. Sometimes, too, buckles may inverted in use, exposing the rear of the latch to other objects.

As one can see from FIG. 3, certain safety belt buckles have a hinged latching plate which is biased forward to its latched position by a spring. The plate is supposedly released only by depression of a push button on the front of the buckle. However, slight impacts delivered directly to the rear of the belt can cause the plate to retract, freeing the male connector. This invention is concerned with the type of connector illustrated.

We have replicated such impacts by delivering measured blows to the rear of seat belt latches from Ford, General Motors and other makes, and can consistently release a belt in this manner. Having found that only a slight impact from the rear is required, we have deduced that it should be possible to reduce the incidence of impact-induced latch failures of this type by surrounding the latch with a cushion to reduce the effects of blows to the rear of the latch.

SUMMARY OF THE INVENTION

An object of the invention is to improve auto safety by reducing the likelihood of a seat belt latch failure during an accident.

Another object of the invention is to cushion a seat belt latch, without interfering with its operation, and without making it difficult to undo the latch.

These and other objects are attained by an impact cushion for a seat belt latch, which cushion includes a sleeve of a soft rubber material sized to slide lengthwise over a female seat belt connector, with an interference fit. The front side of the sleeve has an opening in a position corresponding to the release button of the connector, so that the button is not obstructed. The rear of the cushion is provided with a rigid metal plate; ribs running lengthwise along the inside upper and lower sides of the sleeve normally hold the rear of the seat belt a short distance away from the plate. The cushion is intended to reduce the incidence of seat belt buckle failure during accidents, resulting from impact directly to the buckle.

BRIEF DESCRIPTION OF THE DRAWINGS

In the accompanying drawings.

DESCRIPTION OF THE PREFERRED EMBODIMENT

An impact cushion for a seat belt latch embodying the invention includes a soft latex rubber sleeve 10 having a generally rectangular cross-section, and internal dimensions corresponding to the exterior of a female seat belt connector C for which it is intended, but slightly smaller, so that the sleeve can be pushed lengthwise ever the connector and will remain in place thereafter. One end of the sleeve is partially closed by a short end wall 12, which engages the distal end of the female connector and keeps the sleeve in place.

Figure 1:
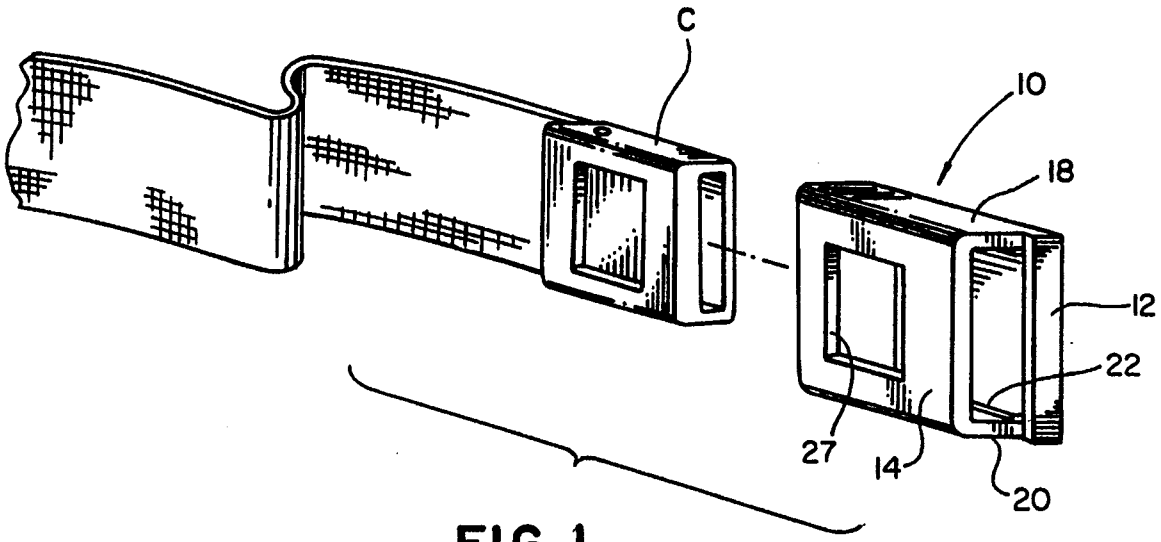
FIG. 1 is an exploded view of the female portion of a seat belt, and an impact cushion embodying the invention.
Figure 3:
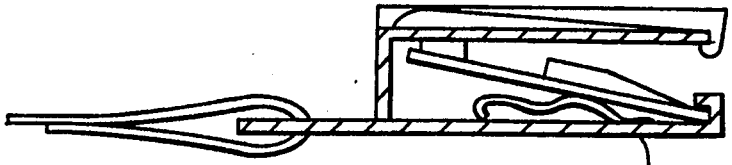
FIG. 3 is a simplified side sectional view of a seat belt buckle, showing the inner workings of the female connector.
Figure 4:
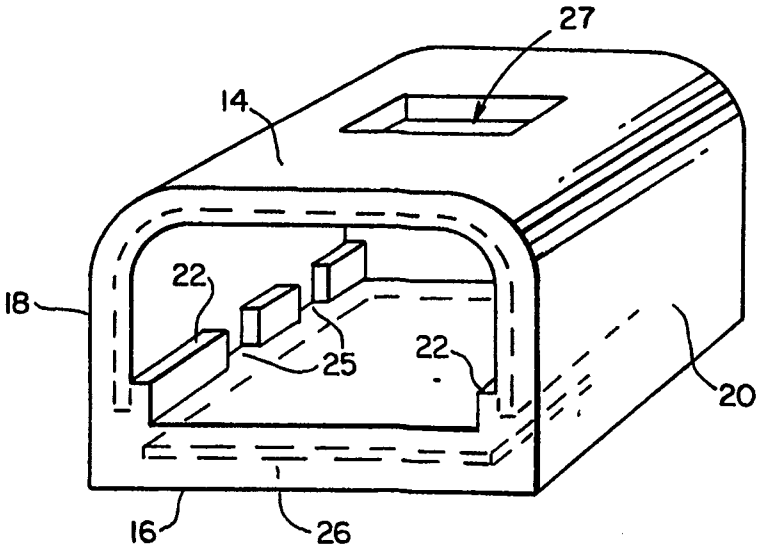
FIG. 4 is a perspective view of the invention, taken from a direction almost opposite that of FIG. 1, showing an impact-absorbing ridge of the device.
Figure 2:
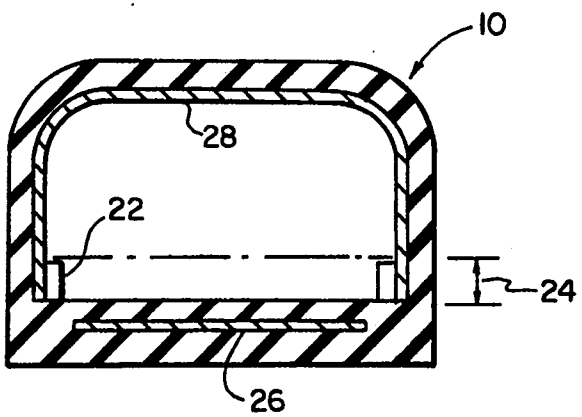
FIG. 2 is a sectional view of the invention, taken along the plane 2—2 in FIG. 1, unexploded.

The sleeve, from the point of view of the passenger, has a front wall 14 toward the front of the car, a rear wall 16 against the passenger's body, and upper and lower side walls 18 and 20 respectively. Two ridges 22, each about $\frac{1}{8}''$ high and $\frac{1}{4}''$ wide, run lengthwise through the sleeve, along the corners between the rear wall and each side wall. When the sleeve is placed over the female connector C, the ridges run directly along the rearward edges of the sides of the connector, and maintain a spacing 24 of about a quarter of an inch (FIG. 2) between the rear of the female connector and the rear wall of the sleeve. The presently preferred ridges are segmented, having $\frac{3}{8}''$ gaps 25 at intervals along the length of the sleeve. The gaps are intended to improve the cushioning effect provided, by reducing the compression stiffness of the ribs. The belt can be released through opening 27.

A metal plate 26, preferably 1/16" thick steel, is molded into the rear wall of the cushion, to reinforce it and prevent substantial flexure. Now, when the sleeve is struck from the rear, the blow is not transferred directly through the bottom wall and the base plate to the buckle. Rather, the force of the impact is distributed to the sides of the buckle via the ridges. We have found that this mode of impact is less likely to result in buckle disengagement. Additionally, the segmented design of the ridges enables them to compress substantially, so that a reduced peak force is transmitted.

So that the cushion maintains its shape, there is an arched insert 28, again preferably of 1/16" thick steel, beneath the sleeve material, extending beneath the front and both sides of the sleeve. This insert is not connected to the base plate. In fact, the base plate can float with respect to it, since the base plate does not extend as far laterally as the ridges. This configuration permits additional flexure of the rubber material beneath the ridges, further reducing the severity of impacts reaching the sides of the buckle.

The preferred material for the sleeve is currently latex rubber reinforced with metal. The nominal thickness of the preferred sleeve is about one-quarter of an inch; however, there are points on the rear wall where the rubber thickness is in the range of a half inch to three-quarters of an inch. We expect that other impact-absorbing materials (for example, dense foams) may be useful for constructing this invention.

The cushion may be made by a variety of methods, depending on the material chosen. One way is to cast or mold rubber around the pre-formed metal plate in a mold. To make the device in quantity, other well-known methods may prove more suitable.

In use, the sleeve is installed over the female connector, with the front opening aligned with the release button. The sleeve, having an interference fit, is thereafter retained in place by friction, and is generally innocuous. When a rear impact occurs, the likelihood of unintended latch release is diminished as the sleeve absorbs energy and distributes impact to the edges of the connector.

While the presently preferred form of the invention is described above, it is expected that other forms may prove suitable or even better. For example, the ridges may be altered so that even less of the cushion touches the rear of the seat belt.

Since the invention is subject to modifications and variations, it is intended that the foregoing description and the accompanying drawings shall be interpreted as illustrative of only one form of the invention, whose scope is to be measured by the following claims.

We claim:

1. A impact cushion for a female seat belt buckle connector comprising a sleeve of an impact-absorbing material having front, rear, upper and lower walls defining therebetween a volume corresponding substantially in size to the connector, the front wall having opening means therein permitting access to a release button of the connector, and wherein the rear wall contains metal reinforcing plate means to protect the buckle connector from rear impacts resulting in inadvertent separation of said female connector from its corresponding male seat belt buckle connector.

2. The invention of claim 1, wherein each of said upper and lower walls have a ridge running lengthwise through the sleeve, along the rear wall, to maintain a space between the rear of the connector and said rear wall.

3. The invention of claim 2, wherein said space is about a quarter of an inch deep.

4. The invention of claim 2, wherein each of said ridges is segmented so that it contacts the buckle connector only at intervals.

5. The invention of claim 1, further comprising at least one partial end wall to engage an end of the connector and bar lengthwise movement of the sleeve on the connector.

6. The invention of claim 1, wherein said impact-absorbing material comprises rubber.

7. The invention of claim 1, wherein said impact-absorbing material is a latex rubber.

8. The invention of claim 1, further comprising an arched metal insert lining the inside of the front and both side walls of the sleeve, without being directly connected to said metal plate.

* * * * *